United States Patent [19]

Colleran

[11] 4,332,432

[45] Jun. 1, 1982

[54] LOW INSERTION FORCE CONNECTOR ASSEMBLY

[75] Inventor: Stephen A. Colleran, Plainfield, Ill.

[73] Assignee: Molex Incorporated, Lisle, Ill.

[21] Appl. No.: 115,332

[22] Filed: Jan. 25, 1980

Related U.S. Application Data

[63] Continuation of Ser. No. 966,897, Dec. 6, 1978, abandoned.

[51] Int. Cl.[3] ..... H01R 13/629

[52] U.S. Cl. ..... 339/75 M

[58] Field of Search ..... 339/75 R, 75 M, 75 MP, 339/91 R, 90 R

[56] References Cited

U.S. PATENT DOCUMENTS 2,998,588 8/1961 Chamberlain ..... 339/75 M 3,750,087 7/1973 Vetter ..... 339/90 R

FOREIGN PATENT DOCUMENTS 1442837 7/1976 United Kingdom ..... 339/75 R

*Primary Examiner*—Eugene F. Desmond

*Attorney, Agent, or Firm*—Louis A. Hecht

[57] ABSTRACT

A connector assembly of the type including a first housing with terminals therein, and a second housing receivable within the first housing with terminals therein adapted to mate with the terminals at the first housing. Both housings are relatively moveable in the first direction with respect to one another between an initial position wherein the second housing is initially received in the first housing and an inserted position wherein the second housing is fully inserted within the first housing so that the terminals of the respective housings are in mating engagement. The improvement includes a generally rectangular-shaped actuator member reciprocally mounted in the first housing with cam slot means formed therein. The actuator is reciprocally moveable in a second direction generally transverse to the first direction between an unlocked position and a locked position. The housings are moved in the first direction to the inserted position in response to moving the actuator in the second direction to the locked position.

9 Claims, 5 Drawing Figures

LOW INSERTION FORCE CONNECTOR ASSEMBLY

This is a continuation of application Ser. No. 966,897 filed Dec. 6, 1978, now abandoned.

BACKGROUND OF THE INVENTION

1. Field of the Invention

The invention generally relates to a connector assembly of the type including a first housing with terminals mounted therein and a second housing receivable within the first housing with terminals mounted therein adapted to mate with the terminals of the first housings. The housings are relatively moveable with respect to one another between an initial position wherein the second housing is initially received in the first housing and an inserted position wherein the second housing is fully inserted within the first housing so that the terminals of the respected housings are in mating engagement. More particularly, the invention resides in an improved means of mating the terminals of said housings.

2. Brief Description of the Prior Art

Electrical connectors of the type described are generally refered to as plug and socket electrical connector assemblies or plug and receptacle electrical connector assemblies. An example generally of such a connector assembly is disclosed in U.S. Pat. No. 3,605,070 which is assigned to the assignee of the present invention.

Because connector assemblies of the type refered to may employ a large plurality of terminals to be mated, a large "insertion force" is generated while attempting to fully mate the terminals of the respective housings. Accordingly, low or zero insertion force connector assemblies have been developed to overcome this problem.

One example of a low or zero insertion force connector having flat blade terminals is disclosed in U.S. Pat. No. 3,915,538 which is assigned to the assignee of the present invention. In that patent, the housings are relatively moveable in a first direction with respect to one another until the second housing is fully received in the first housing. However, when the housings are fully inserted, the flat blade terminals are still spaced apart and are brought into mating engagement when the housings are moved in response to an actuator member moving in the same plane as the movement of the terminals.

Another example of a low or zero insertion force connector assembly is disclosed in U.S. Pat. No. 3,954,698. In that patent the connector assembly includes a rotatable actuator member which brings the terminals of the respective housings into mating engagement.

SUMMARY OF THE INVENTION

It is the principal object of the present invention to provide an improved connector assembly of the type which has a first housing with at least one terminal therein, and a second housing receivable within the first housing with at least one terminal mounted therein and adapted to mate in axial engagement with the terminal of the first housing, said housings being relatively moveable in a first direction with respect to one another between an initial position wherein the second housing is initially received in the first housing and an inserted position wherein the second housing is fully inserted within the first housing so that the terminals of the respective housings are in mating engagement.

The improvement comprising the invention is an improved actuating means associated with said housings for mating the two housings and their respective terminals generating a relatively low insertion force. The improved actuating means generally includes an actuator member mounted on one of the housings for movement in a second direction generally transverse and nonplanar to the first direction between an unlocked position and a locked position; and interengaging cam means associated between the other of said housings and said actuator member. The cam means is interengaged when the actuator member in said unlocked position and said housings are in said initial position, whereby said housings are moved in said first direction to said inserted position when said actuator member is moved in such second direction to the locked position.

DESCRIPTION OF THE PREFERRED EMBODIMENT

Figure 1:
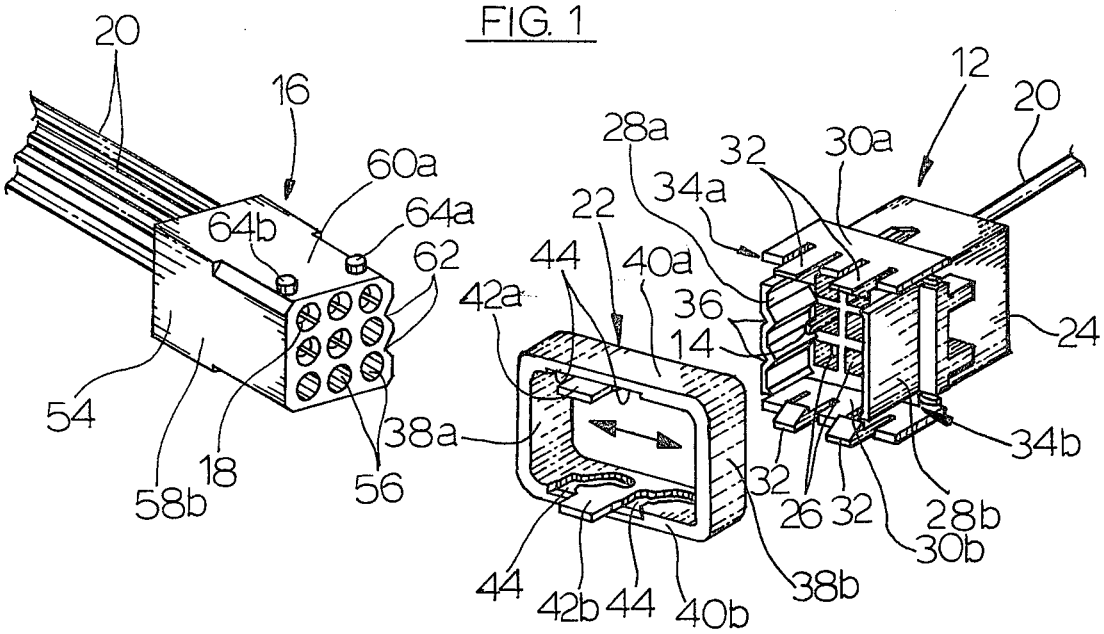
FIG. 1 is an exploded perspective view of the connector assembly of the present invention.

Looking at FIG. 1, the connector assembly of the present invention is seen to generally include a first housing, generally designated 12, having male terminals 14 mounted therein and a second housing, generally designated 16, having female terminals 18 mounted therein which are adapted to axially engage terminals 14. The first housing 12 is sometimes refered to as a socket or receptacle while the second housing 16 is sometimes refered to as a plug. Each of the terminals 14 and 18 in both housings 12 and 16, respectively, are crimped onto insulation clad wire 20. This harness wire 20 is in turn connected to other parts of an electrical circuit.

In order to easily move the housings 12 and 16 toward each other so that the terminals 14 and 18 are electrically mated, there is provided a generally rectangular shaped actuator member, generally designated 22. Rather than providing a large amount of force to mate all of the terminals 14 and 18, movement of the actuator member 22 produces a mechanical advantage in a manner which will be discussed in greater detail hereinafter that results in a lower insertion force.

Looking at FIG. 1, the first housing 12 is seen to generally include a base 24 having core pins 26 formed therein. The core pins 26 are used to mount the respective male terminals 14 in the housing 12.

Extending from the base 24 of the first housing 12 are two side guide walls **28*a* and 28*b* and two spaced apart opposing end walls 30*a* and 30*b*. The end walls 30*a* and 30*b* each have a pair of actuating locking members 32 formed therein. The side guide walls 28*a* and 28*b* do not extend all the way to the respective end walls 30*a* and 30*b*. Therefore, actuator receiving slots 34*a* and 34*b* are formed in the space between the end of the side guide walls 28***a* and 28*b* and the ends walls 30*a* and 30*b*.

Side guide wall 28*a* has a pair of polarizing grooves 36 formed therein which mate with portions of the second housing 16 as will be discussed in greater detail hereinafter. The polarizing feature allows the respective housings 12 and 16 to be mated together in only one way.

Figure 4:
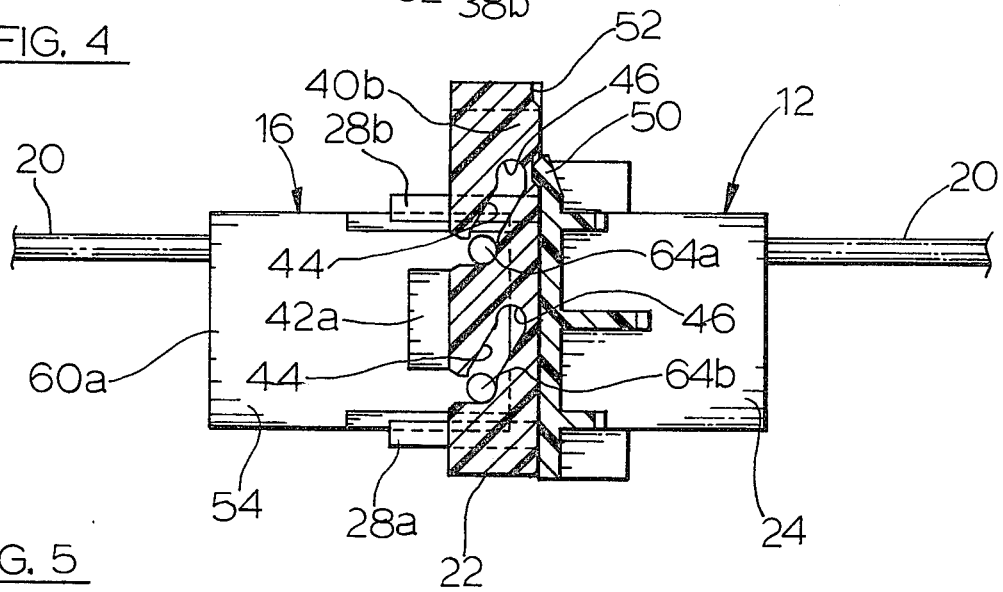
FIG. 4 is a sectional view taken generally along the line 4—4 of FIG. 2.
Figure 5:
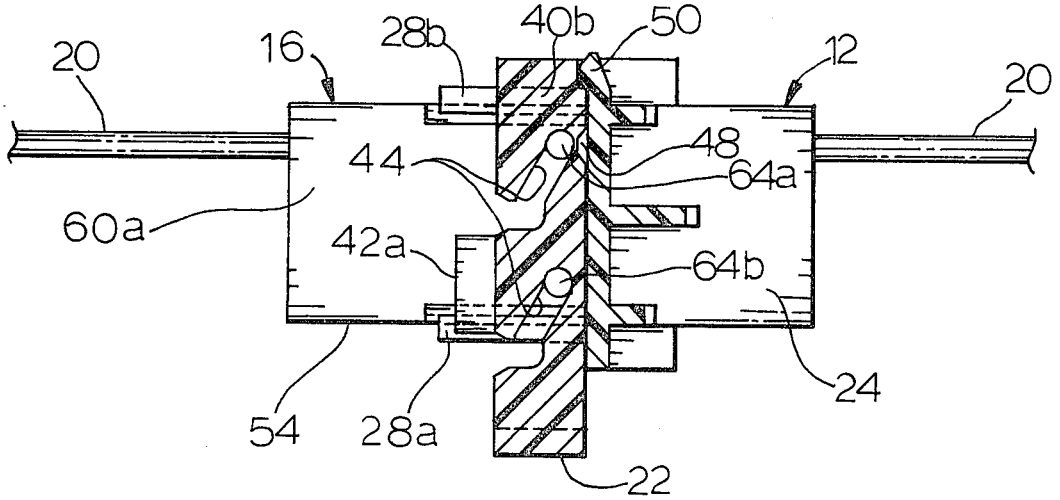
FIG. 5 is a section view taking generally along the line 5—5 of FIG. 3.

Looking now at FIGS. 1, 4 and 5, the actuator member 22 is seen to be reciprocally mounted within the actuator receiving slots 34*a* and 34*b* of the first housings 12 and captured therein by the locking members 32. When so mounted the actuator member is moveable in a reciprocal fashion in the direction indicated by the double ended arrow in FIG. 1.

The actuator member 22 includes two parallel spaced apart actuator walls 38*a* and 38*b* which are joined by two parallel spaced apart cam slot walls 40*a* and 40*b*. The cam slot walls 40*a* and 40*b* include an upstanding cam guide 42*a* and 42*b*, respectively, and a pair of inclined cam slots 44. Each cam slot has a lower dwell portion 46 for reasons which will become more apparent hereinafter. The cam slot walls 40*a* and 40*b* each have a detent recess 48 and 52 formed in the bottom thereof which is adapted to snap fit with a detent nib 50 formed within each actuator receiving slot 34*a* and 34*b*. (See FIGS. 4 and 5)

Looking at FIG. 1, the second housing 16 is seen to generally include a plug body 54 having core pins 56 formed therein to receive the female terminals 18. The plug body 54 has two opposing side walls 58*a* and 58*b* joined by two opposing end walls 60*a* and 60*b*.

End wall 68*a* has a pair of polarizing grooves 62 which are formed to be complementary with the polarizing grooves 36 formed on the side guide wall 28*a* of the first housing 12. Each end wall 60*a* and 60*b* has a pair of bosses 64*a* and 64*b*, respectively, which are adapted to be received in the respective inclined cam slots 44 formed in the actuator member 22.

Figure 2:
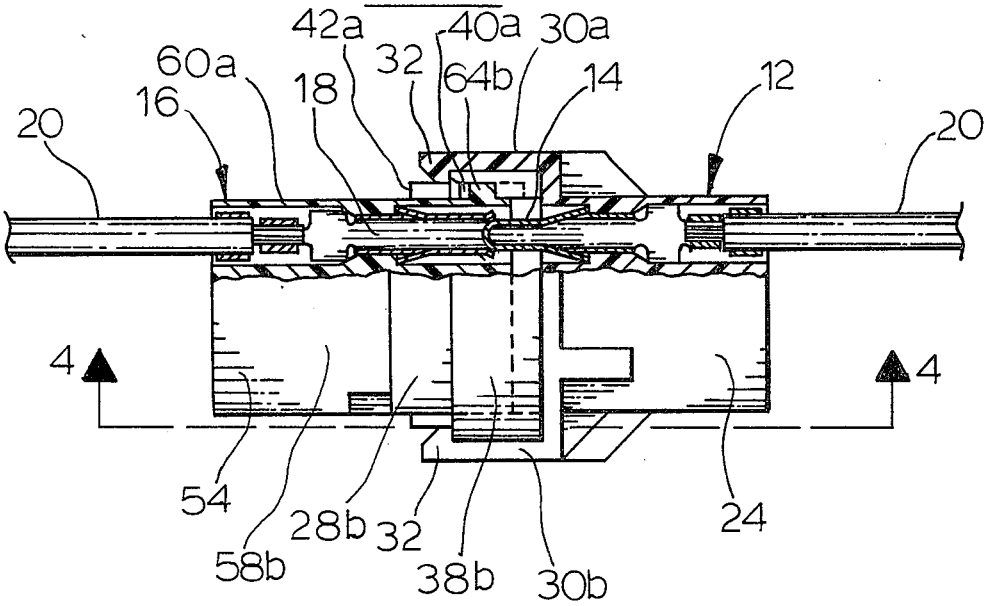
FIG. 2 is a side view of the connector assembly, partially in section, when said assembly is in the initial position.

In use, the first housing 12 is provided with the actuator member 22 already mounted within the actuator receiving slots 34*a* and 34*b* and held in reciprocal fashion by means of the locking member 32. The two housings 12 and 16 are then moved in a first direction toward each other. This direction is parallel to the longitudinal axis of the respective terminals 14 and 18. The housings 12 and 16 reside in an initial position as shown in FIGS. 2 and 4 wherein the second housing 16 is initially received in the first housing 12 so that the respective terminals 14 and 18 are about ready to touch one another.

The housings 12 and 16 are then moved further toward each other in the first direction by means of moving the actuator member 22 in a second direction generally transverse to the first direction between an unlocked position as shown in FIG. 4 to a locked position as shown in FIG. 5. When in the unlocked position, (FIGS. 2 and 4) the bosses 64*a* and 64*b* are initially received in the cam slots of 44. In addition, the upstanding cam guide 42*a* and 42*b* are received between the bosses 64*a* and 64*b*. This insures stabilization of the housings 12 and 16 with respect to one another.

As the actuator member 22 is moved from the position shown in FIG. 4 to the position shown in FIG. 5 (or, from the unlocked position to the locked position), the housings 12 and 16 are brought together so that the respective terminals 14 and 18 are mated together. More particularly, the second housing 16 is captured within the guide walls 28*a* and 28*b* while the bosses 64*a* and 64*b* are moved downwardly in the inclined cam slots 44 until they reach the dwell portion 46 thereof as is best shown in FIG. 5.

Figure 3:
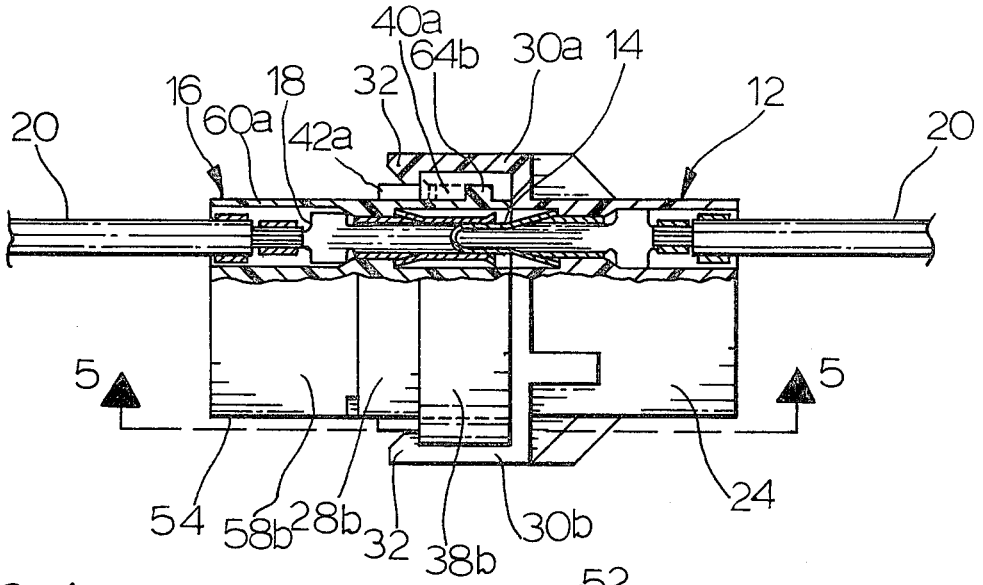
FIG. 3 is a side view similar to that of FIG. 2 wherein the housings of the connector assembly of the present invention are in the inserted position.

When the actuator member 22 is in the locked position as shown in FIGS. 3 and 5, opposing forces placed on the housings 12 and 16 away from each other will not result in the bosses 64*a* and 64*b* traveling back up the inclined slot 44. This is due to the dwell portion 46. The only way the housings 12 and 16 can be disconnected would be to move the actuator member 22 upwardly from the position shown in FIG. 5 to the unlocked position shown in FIG. 4.

Also, as is best seen in FIGS. 3 and 5, there is a detent action associated with the movement of the actuator member 22 between its locked and unlocked positions. More particularly, when the actuator member 22 is in the unlocked position the detent nib 50 is received within the detent recess 48. After the actuator member 22 is moved to the locked position (FIG. 5), the detent nib is then received within the second detent recess 52. As the detent nib 50 moves between recess 48 and 52, a clicking sound and a over-center feel is detected.

Other variations of the concept of the invention is disclosed herein may be apparent to those skilled in the art. For example, one could easily reverse the parts as between the different housings 12 and 16 as they relate to the actuator member 22. It is intended that these obvious variations comprising a mere reversal of parts is intended to be covered by the claims of this invention.

I claim:

1. In a connector assembly including a first housing, a second housing received within said first housing and moveable in a first direction toward and away therefrom between an initial position and a fully inserted position, and at least one pair of terminals, one being mounted in the first housing and the other terminal being mounted in the second housing, said pair of terminals having aligned longitudinal axes, each terminal having a mating portion engaging the mating portion of the other terminal when said terminals of said pair are axially moved toward each other in response to movement of the housings to the fully inserted position, the improvement comprising:

an actuator member mounted on one of the housings for reciprocal and linear movement in a second direction generally transverse to said first direction between an unlocked position and a locked position; and interengaging cam means associated between the other of said housings and said actuator member, said cam means including inclined cam slot means defined between two spaced apart opposed surfaces and cam follower means receivable and moveable within said slot means, the cam follower means and one of the surfaces exerting a force against each other when the actuator is moved from the unlocked to the locked positions, the cam follower means and the other of said surfaces exerting a force against each other when the actuator is moved from the locked to the unlocked position, whereby said housings are moved between said initial and inserted positions when said actuator member is moved between the unlocked and locked positions, said cam means including a locking portion to prevent the housings from moving from the inserted position to the initial position except by movement of the actuator member from the locked position.

2. The connector assembly of claim 10 wherein said inclined cam slot means is formed in said actuator member and said cam follower means is formed on said other housing.

3. The connector assembly of claim 2 wherein said actuator member is mounted on said first housing and said other housing is said second housing.

4. The connector assembly of claims 2 or 3 wherein said slot means includes a flat dwell profile portion to prevent the housings in the inserted position to move to the initial position except by movement of the actuator member from the locked position.

5. In the connector assembly of the type including a first housing with at least one terminal therein, and a second housing receivable within the first housing with at least one terminal mounted therein adapted to mate with the terminal of the first housing, said housings being relatively moveable in a first direction with respect to one another between an initial position wherein the second housing is initially received in said first housing and an inserted position where the second housing is fully inserted within the first housing so that the terminals of the respective housings are in mating engagement, actuating means associated with said housings comprising:

two spaced apart slots formed in said first housing parallel to and adjacent to the ends thereof:

a generally rectangular-shaped actuator member reciprocally mounted in the slots of the first housing including a first pair of parallel walls and a second pair of parallel walls joining the first pair each of said first pair of walls having a cam slot means defined between two spaced apart opposed surfaces formed therein, the length of the second pair of walls being substantially the same as the distance between the slots in the first housing for mounting within said slots, the length of the first pair of walls being sufficiently large so that the second pair of walls are outside of said first housing, said actuator member being mounted for linear and reciprocal movement in a second direction generally transverse to said first direction between an unlocked position defined when one of second pair of walls abut against the outside of the first housing and a locked position wherein the other of said second pair of walls abut against the outside of the first housing; and a pair of cam follower means formed on opposite sides of the second housing and receivable and moveable within the cam slot means, the cam follower means and one of the surfaces exerting a force against each other when the actuator is moved from the unlocked to the locked positions, the cam follower means and the other of said surfaces exerting a force against each other when the actuator is moved from the locked to the unlocked positions, whereby said housings are moved between said initial and inserted positions in response to moving the actuator between said unlocked and locked positions.

6. The connector assembly of claim 5 wherein each cam slot means includes two spaced apart inclined slots and wherein each cam follower means includes two spaced apart bosses receivable within the respective slots.

7. The connector assembly of claim 6 wherein each slot includes a flat dwell profile portion to prevent the housings in the inserted position to move to the initial position except by movement of the actuator member from the locked position to the unlocked position.

8. The connector assembly of claim 5 including cooperating polarizing means formed having a profile formed on the first housing which slidingly mates with a complementary profile formed on the second housing.

9. The connector assembly of claim 5 including actuator detent means cooperating between the first pair of actuator member walls and the first housing slots for providing detent when the actuator member is moved between the locked and unlocked positions.

* * * * *